US006285829B1

(12) United States Patent
Smith

(10) Patent No.: US 6,285,829 B1
(45) Date of Patent: Sep. 4, 2001

(54) RADIANT ELECTRIC SPACE HEATER

(75) Inventor: Barry W. Smith, Centerville, OH (US)

(73) Assignee: The W. B. Marvin Manufacturing Company, Urbana, OH (US)

( * ) Notice: Subject to any disclaimer, the term of this patent is extended or adjusted under 35 U.S.C. 154(b) by 0 days.

(21) Appl. No.: 09/227,236

(22) Filed: Jan. 8, 1999

Related U.S. Application Data

(60) Provisional application No. 60/071,098, filed on Jan. 9, 1998.

(51) Int. Cl.[7] ..... A61M 16/02; F24D 13/00

(52) U.S. Cl. ..... 392/390; 392/347

(58) Field of Search ..... 392/386, 390, 392/391, 394, 403, 405, 406, 347, 349, 352, 354, 355; 261/139, 142, DIG. 65

(56) References Cited

U.S. PATENT DOCUMENTS

| | | | | |
|---|---|---|---|---|
| 1,810,650 | | 6/1931 | Fay . | |
| 1,836,253 | | 12/1931 | Johnson et al. . | |
| 1,892,882 | | 1/1933 | Gannon et al. . | |
| 1,900,956 | | 3/1933 | Somersall . | |
| 2,847,734 | * | 8/1958 | Tauben | 392/337 |
| 2,885,527 | * | 5/1959 | Tone et al. | 392/337 |
| 3,105,892 | | 10/1963 | Knapp . | |
| 4,285,905 | | 8/1981 | Feit . | |
| 4,571,485 | | 2/1986 | Spector . | |
| 4,617,157 | | 10/1986 | Stein et al. . | |
| 4,666,670 | | 5/1987 | Cox . | |
| 4,906,417 | * | 3/1990 | Gentry | 261/30 |
| 5,636,319 | * | 6/1997 | Glucksman et al. | 392/406 |
| 5,970,211 | * | 10/1999 | Ritsher et al. | 392/403 |

* cited by examiner

*Primary Examiner*—Sang Paik
(74) *Attorney, Agent, or Firm*—Roger S. Dybvig

(57) ABSTRACT

This invention relates to a radiant electric space heater capable of acting also as an air freshener. In accordance with this invention, a space heater having a humidifier is provided with a potpourri dish capable of holding liquid or other scented potpourri. The potpourri dish is provided in a position to be heated, thereby efficiently freshening the surrounding air space.

8 Claims, 4 Drawing Sheets

RADIANT ELECTRIC SPACE HEATER

CROSS REFERENCE TO RELATED APPLICATION

This application claims the benefit of copending U.S. Provisional Application Ser. No. 60/071,098, filed Jan. 9, 1998.

FIELD OF THE INVENTION

This invention relates to a radiant electric space heater and, although not so limited, this invention is particularly directed to a portable horizontal radiant electric space heater for household use.

INCORPORATION BY REFERENCE

The disclosures of U.S. Pat. Nos. 5,381,509 and 5,437,001 are hereby incorporated by reference herein. A copy of each of these patents is enclosed. These patents show, respectively, a horizontal electric space heater and an upright electric space heater.

BACKGROUND OF THE INVENTION

Space heaters of the type shown in the aforementioned patents are highly satisfactory for their intended use for providing radiant heat to the surrounding space. However, their use is limited to supplying heat, and in some cases to serve as an humidifier, and it is advantageous to provide an electric space heater capable of performing another function.

SUMMARY OF THE INVENTION

An object of this invention is to provide an improved electric space heater capable of acting also as an air freshener. In accordance with this invention, a space heater is provided with a potpourri dish in a position to be heated and thereby efficiently freshen the surrounding air space.

Other objects and advantages will become apparent from the following description and the drawings.

DETAILED DESCRIPTION

Figure 1:
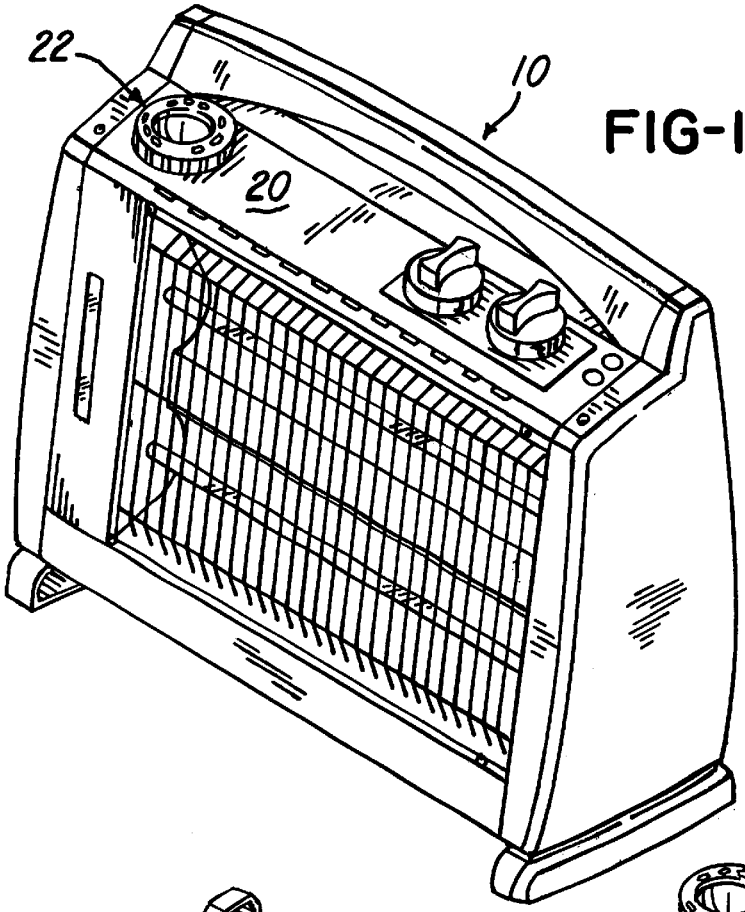
FIG. 1 is a perspective view of a space heater provided with a humidifier in accordance with this invention.

A radiant space heater 10 is shown in FIG. 1 which is of the type shown in the aforementioned U.S. Pat. No. 5,381,509 and is provided with a steamer or humidifier 12 including a water container 13 having a drain 14 and connected by tubing 16 to an outlet port 18, which may be made from a heat-resistant plastic material. Water within the tubing 16 is heated by a conventional heating element 21. The foregoing parts may be entirely conventional except for the construction of the outlet port 18. The outlet port 18 is designed to snap into the top wall 20 of the heater cabinet and to support a plastic potpourri cup 22 above the top wall 20.

Figure 2:
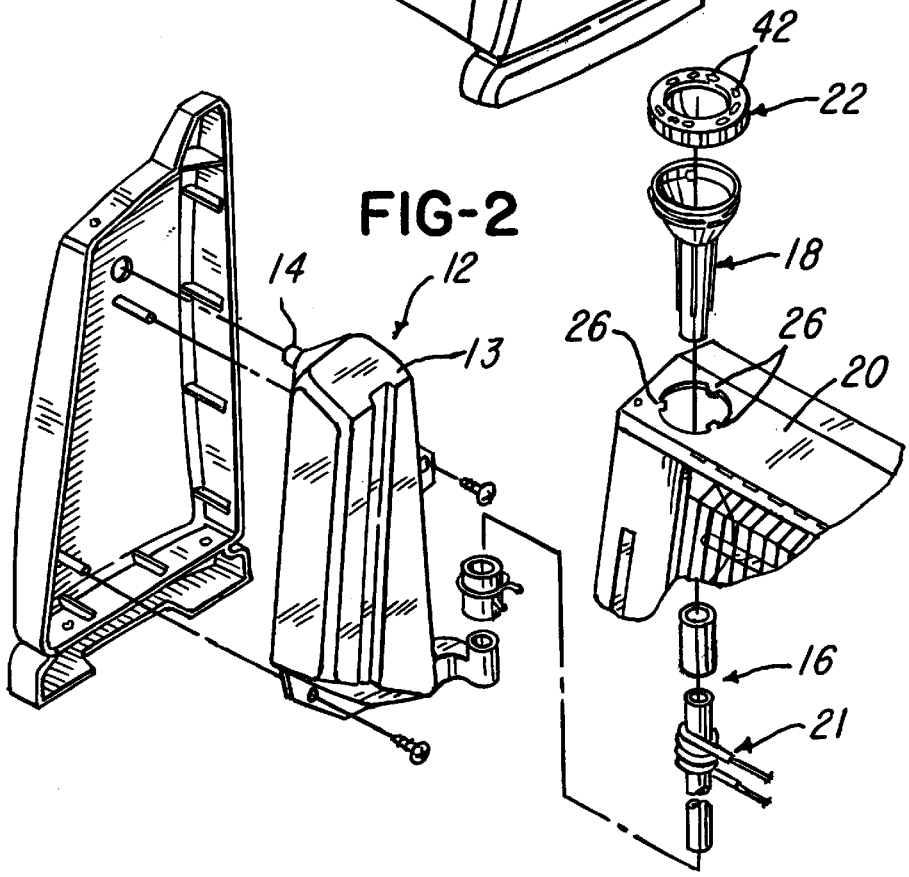
FIG. 2 is a fragmentary, exploded perspective view of a portion of the space heater of FIG. 1.
Figure 3:
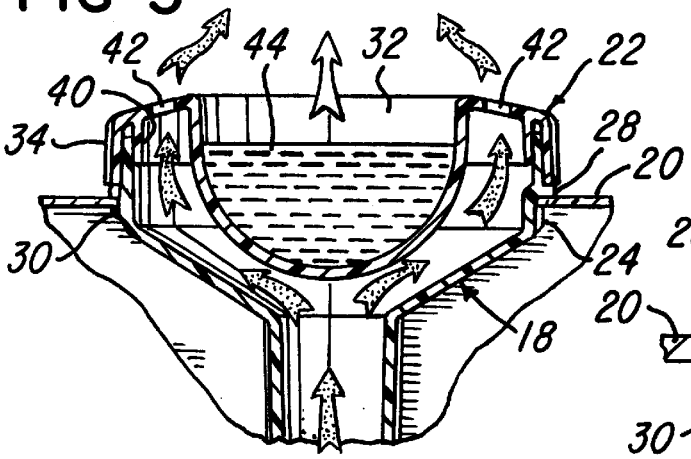
FIG. 3 is a fragmentary cross-sectional view of a portion of the heater of FIG. 1, and diagrammatically illustrates the passage of steam from the heater.
Figure 4:
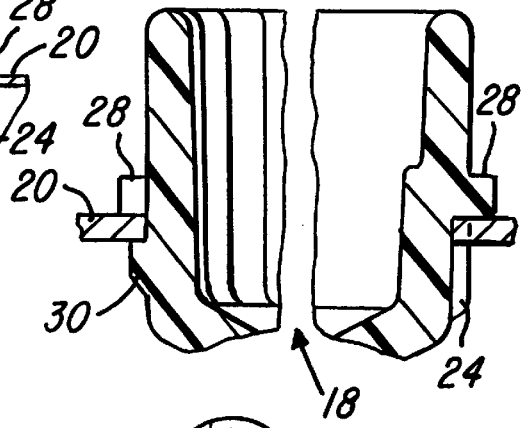
FIG. 4 is a fragmentary, enlarged, cross-sectional view showing details of the outer surface of a steam outlet port illustrated in FIG. 3.
Figure 5:
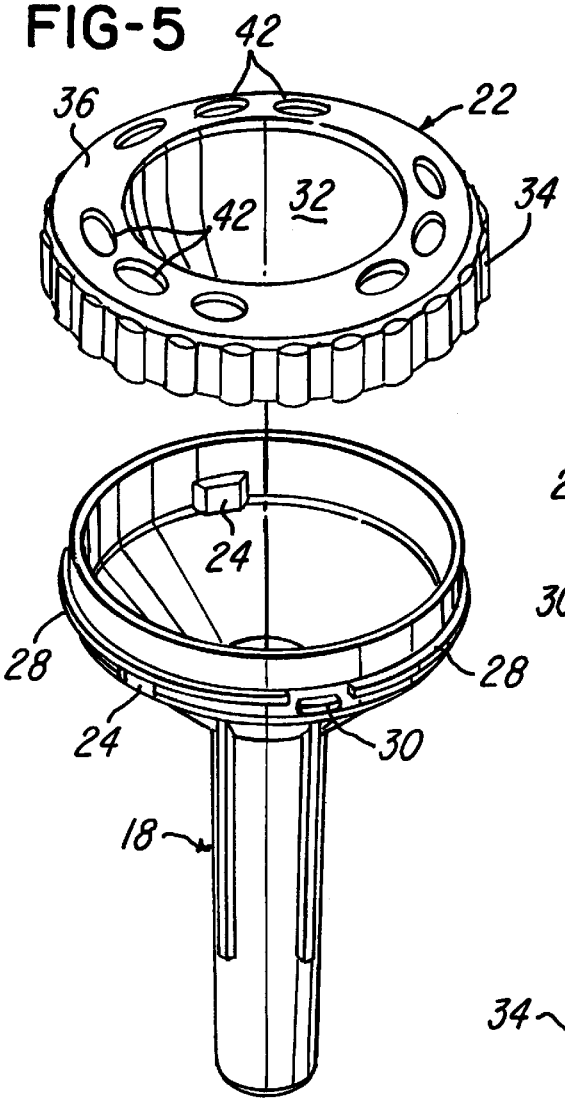
FIG. 5 is an exploded perspective view of a steam outlet port and a potpourri cup forming part of the heater of FIG. 1.
Figure 6:
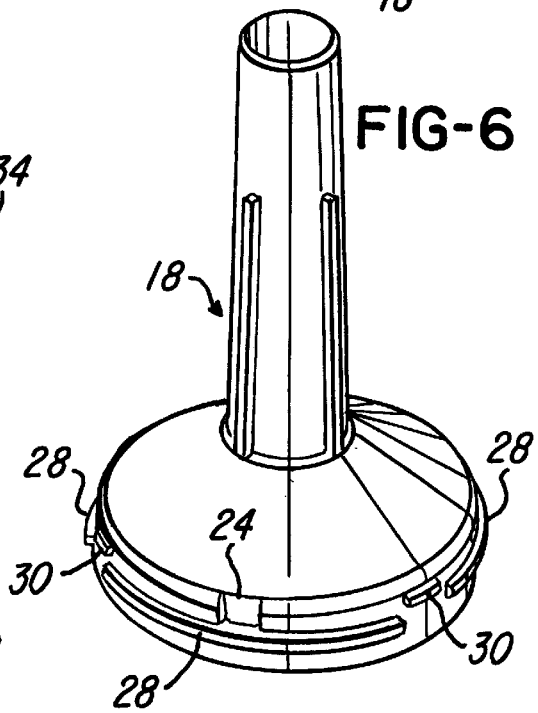
FIG. 6 is an inverted perspective view of the outlet port of FIG. 5.

As shown best in FIG. 5, the outlet port 18 has indented sockets 24 that receive tabs 26 (FIG. 2) formed on the top wall 20 that prevent the outlet port 18 from rotating. Annular ribs 28 and 30 formed on the outer surface of the outlet port 18 enable the outlet port 18 to be snap fitted onto and grip the top cabinet wall 20, as can be determined from FIGS. 3 through 6.

Figure 7:
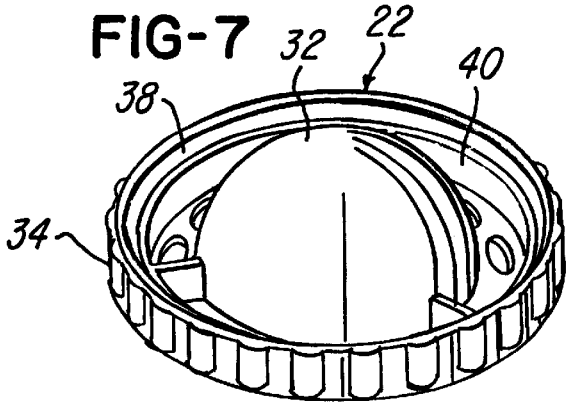
FIG. 7 is an inverted perspective view of the potpourri cup of FIG. 5.
Figure 8:
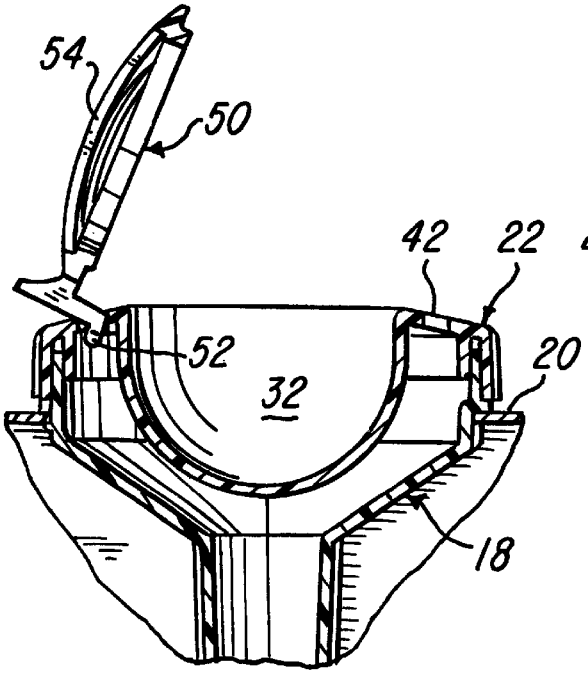
FIG. 8 is a fragmentary cross-sectional view similar to FIG. 3 and showing a steam cover guard which may be used with the outlet port and the potpourri cup of FIG. 5.

The potpourri cup 22 has a cup portion 32 surrounded by an outer skirt 34 from which it is spaced by a ring-shaped upper wall 36 that surrounds the open upper end of the cup portion 32. An annular recess 38 (FIG. 7) formed between the skirt 34 and an annular inner wall 40, shown best in FIGS. 3 and 7, enables the potpourri cup 22 to be held onto the top of the outlet port 18.

During operation of the heater 10, steam formed by the humidifier rises upwardly through the tubing 16 and out through steam-exit openings 42 in the upper wall 36 of the potpourri cup 22. The rising steam strikes the bottom of the cup portion 32, heating liquid potpourri or other scented liquid 44 therein, whereupon scented gases are emitted into the surrounding atmosphere.

Figure 11:
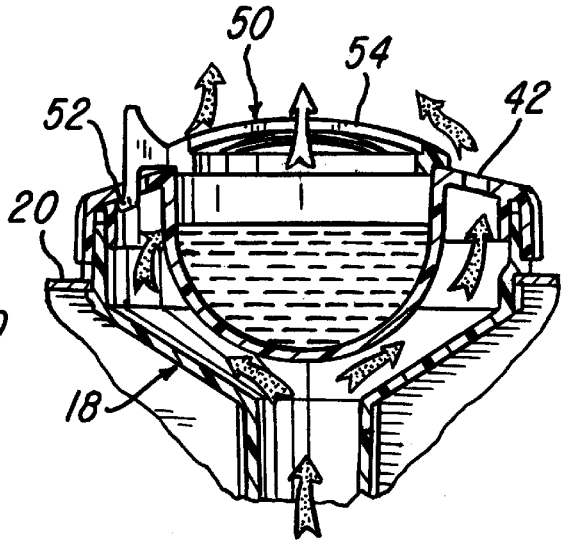
FIG. 11 is a fragmentary cross-sectional view similar to FIG. 8, but with the cover guard closed, and diagrammatically showing the path of the steam exiting the outlet port and the fragrant gas exiting the potpourri cup.
Figure 10:
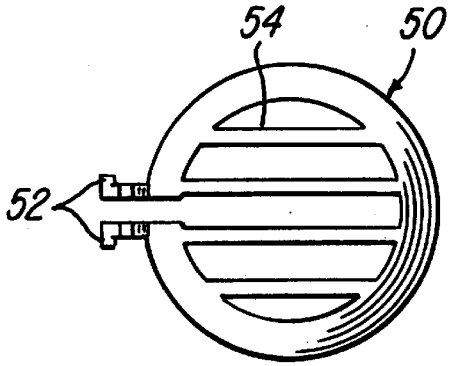
FIG. 10 is a plan view of the cover guard.
Figure 9:
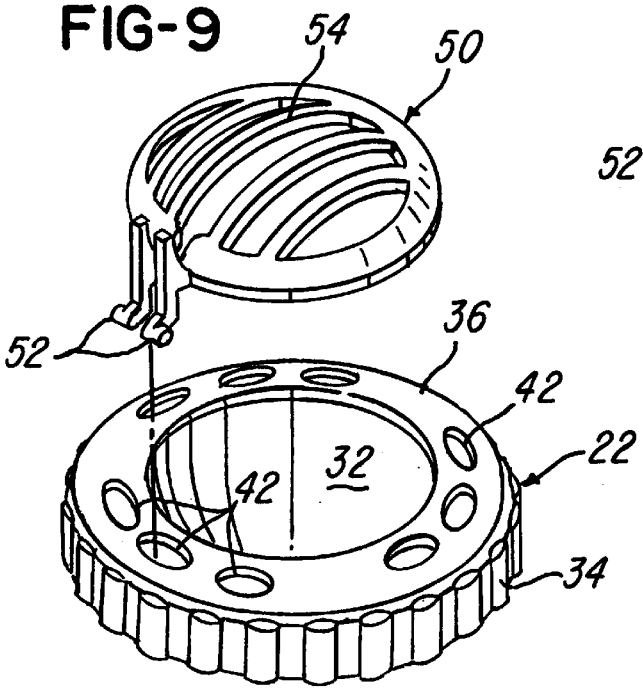
FIG. 9 is an exploded perspective view illustrating the manner in which the outlet port can be mounted on the potpourri cup.

FIGS. 8 through 11 show a plastic steamer cover guard 50 pivotally mounted on the potpourri cup 22. The construction of the guard 50 is evident from the drawings. It is formed with integral pivot pins 52 that may be sprung toward one another to fit within one of the steam exit openings 42. The guard 50 forms a grid 54 which limits any unwanted splashing of the scented liquid but permits scented gas to escape as can be seen in FIG. 11.

Figure 12:
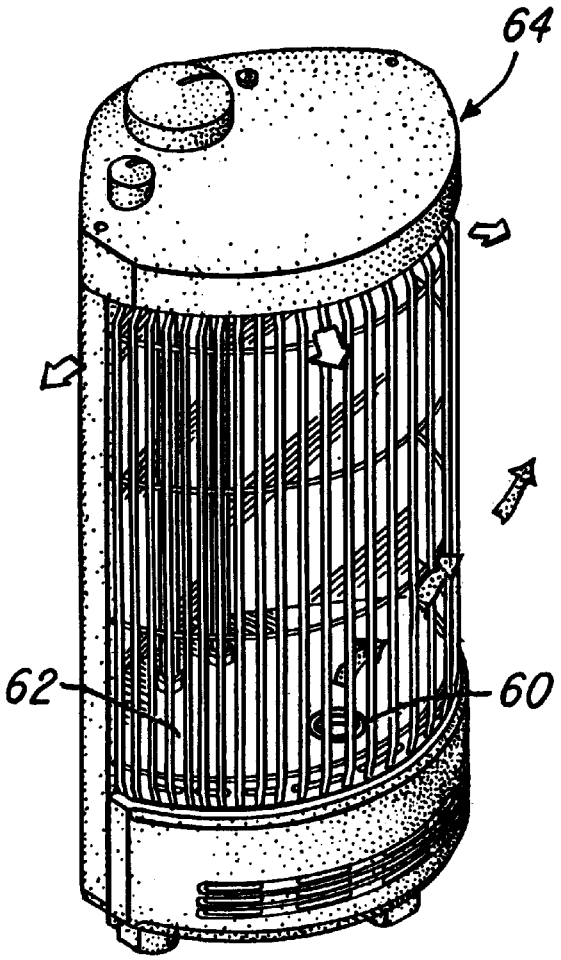
FIG. 12 shows a vertical radiant heater provided with a potpourri cup in accordance with this invention.
Figure 13:
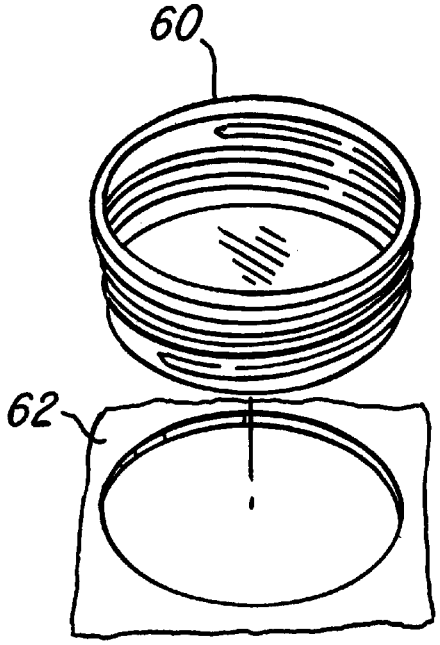
FIG. 13 is a fragmentary perspective view showing the mounting of the potpourri cup in the space heater of FIG. 12.

FIGS. 12 and 13 show a potpourri cup 60 mounted in the bottom reflector wall 62 of a vertical space heater 64 of the type shown in the aforementioned U.S. Pat. No. 5,437,001. The potpourri cup 60 is heated by conduction as the inside of the heater becomes hot during use.

Although the presently preferred embodiments of this invention have been described, it will be understood that within the purview of the invention various changes may be made within the scope of the following claims.

Having thus described our invention, I claim:

1. A radiant electric space heater comprising:

at least one radiant heating element for heating objects in a space adjacent said space heater;

a cup mounted on said space heater and capable of holding liquid potpourri or other scented liquid;

means for heating said cup and its contents to emit a scented gas into said space; and an outlet port having a bottom opening and a top opening, said outlet port mounted to said space heater, and said top opening of said outlet port capable of receiving said cup.

2. The radiant space heater of claim 1 further comprising a humidifier for producing steam connected to said bottom opening of said outlet port.

3. The radiant space heater of claim 2 wherein said cup includes an upper wall and a bottom wall, steam-exit openings formed in said upper wall, wherein steam from said humidifier rises through said outlet port and strikes said bottom of said cup received within said top opening of said outlet port thereby heating said cup and its contents of said liquid potpourri or other scented liquid, and wherein said steam exits said steam-exit openings in said upper wall of said cup.

4. The radiant space heater of claim 3 wherein a steam cover guard is pivotally mounted to said potpourri cup to limit any unwanted splashing of said liquid potpourri or other scented liquid while permitting scented gas to escape.

5. The radiant space heater of claim 1 wherein a steam cover guard is pivotally mounted to said potpourri cup to limit any unwanted splashing of said liquid potpourri or other scented liquid while permitting scented gas to escape.

6. A radiant electric space heater comprising:

at least one radiant heating element for heating objects in a space adjacent said space heater;

a cup mounted on said space heater and capable of holding liquid potpourri or other scented liquid; and means for heating said cup and its contents to emit a scented gas into said space, said means for heating comprising a humidifier for producing steam that strikes said cup.

7. A radiant electric space heater comprising:

a housing;

a radiant heating assembly in said housing;

a cup capable of holding liquid potpourri or other scented liquid mounted on said housing; and a humidifier within said housing having a steam outlet, said cup being mounted in a position to be heated by steam exiting from said humidifier.

8. The radiant space heater of claim 7 wherein a steam cover guard is pivotally mounted to said potpourri cup to limit any unwanted splashing of said liquid potpourri or other scented liquid while permitting scented gas to escape.

* * * * *